United States Patent [19]

English

[11] Patent Number: 4,478,002

[45] Date of Patent: Oct. 23, 1984

[54] INTERIOR SECURITY WINDOW PANEL

[75] Inventor: Thomas A. English, Oklahoma City, Okla.

[73] Assignee: Interior Security Corp., Oklahoma City, Okla.

[21] Appl. No.: 430,347

[22] Filed: Sep. 30, 1982

[51] Int. Cl.[3] ..... E06B 3/68

[52] U.S. Cl. ..... 49/57; 49/62; 292/148

[58] Field of Search ..... 49/56, 57, 62, 63; 292/148

[56] References Cited

U.S. PATENT DOCUMENTS

| | | | |
|---|---|---|---|
| 250,592 | 12/1881 | Smith | 49/57 X |
| 3,451,703 | 6/1969 | Roegner | 292/148 |
| 3,745,704 | 7/1973 | Covington | 49/57 |

*Primary Examiner*—Kenneth Downey
*Attorney, Agent, or Firm*—Edwin H. Crabtree

[57] ABSTRACT

An interior security window panel for receipt inside the frame of a window and adjacent thereto to prevent the unlawful entrance through the window. The window panel secured to the inside of the window frame to prevent removal of the panel from outside the building.

2 Claims, 5 Drawing Figures

INTERIOR SECURITY WINDOW PANEL

BACKGROUND OF THE INVENTION

This invention relates to a window panel for mounting adjacent a window and more particularly but not by way of limitation to an interior security window panel adapted for mounting inside a window frame and adjacent the window to prevent unlawful entrance by a human therethrough.

Heretofore there have been various window and patio door security systems such as U.S. Pat. No. 4,226,049 to Maust, U.S. Pat. No. 4,325,203 to Wicks, U.S. Pat. No. 2,222,667 to Kitzelman, U.S. Pat. No. 2,136,042 to Cornell et al, U.S. Pat. No. 1,996,931 to McGuinness, U.S. Pat. No. 988,510 to Rosenzweig, U.S. Pat. No. 3,167,828 to Hutchisson, Jr. and U.S. Pat. No. 4,059,923 to Sauer. None of the mentioned patents provide the unique features and advantages of the subject invention as described herein.

SUMMARY OF THE INVENTION

The subject invention provides an interior security panel which may be easily removed in case of emergency or general window maintenance.

Further the panel is readily adaptable for installing in various sizes and shapes of windows an does not interfer with drapes, blinds or shutters. Further the panel is installed inside the window frame and adjacent the side of the window making it impossible to remove the panel from the outside without first unlocking the panel from the inside.

The window panel is attractive in appearance and is designed to have different types of styles. Further the panel is rugged in construction and most importantly is designed to prevent unlawful entrance through the window into the interior of a building.

The interior security window panel for receipt inside a window frame to prevent the unlawful entrance through the window includes a panel frame having first and second side members adjacent to the sides of the window and an upper and lower member adjacent the top and bottom of the window. The panel frame has cross members attached to the frame and disposed in a spaced relationship to each other wherein the space is small enough to prevent human entrance therethrough. The upper member of the panel is received in a "U" shaped channel attached to the top of the window frame. The panel frame is secured to the bottom of the window frame by a "L" shaped locking pin or any other similar locking device.

The advantages and objects of the invention will become evident from the following detailed description of the drawings when read in connection with the accompanying drawings which illustrate preferred embodiments of the invention.

DETAILED DESCRIPTION OF THE DRAWINGS

Figure 1:
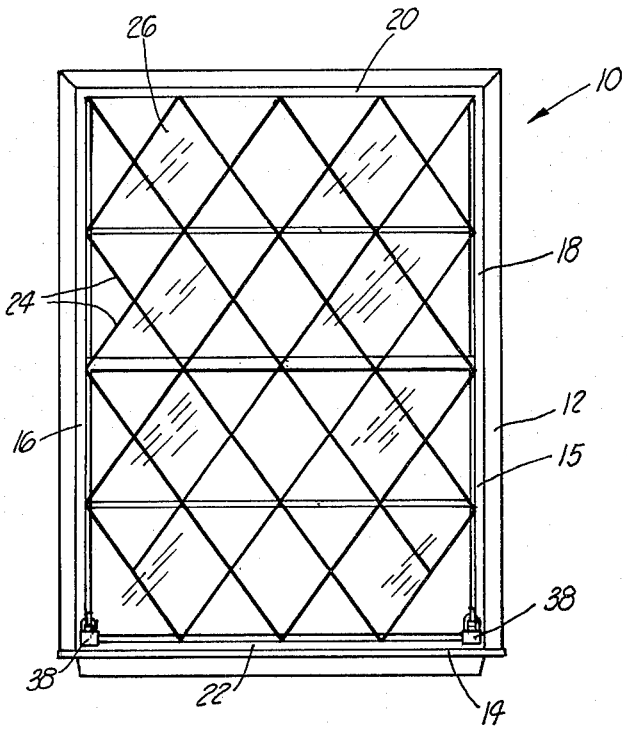
FIG. 1 is a front view of the interior security window panel mounted inside the window frame.

In FIG. 1 the interior security window panel is designated by general reference numeral 10. The panel 10 is installed inside a window frame 12 having a window sill 14. The panel 10 includes a panel frame 15 having a first side member 16, a second side member 18, an upper member 20 and a lower member 22. Attached to the first and second side members 16 and 18 and upper and lower members 20 and 22 are cross members 24 disposed in a spaced relationship to each other but the spacing being small enough to prevent human entrance therethrough. The cross members 24 in this illustration form a diamond configuration. It can be appreciated that the cross members 24 could also be attached to the panel frame 15 forming a rectangle configuration or any other type of configuration that would be equally pleasing to the eye.

Also shown in FIG. 1 is the panel frame 15 disposed in front of a window 26. It should be noted that the panel 10 is mounted inside the building and adjacent the window 26 so no entrance can be gained through the window by removing the security panel 10 from the outside.

Figure 2:
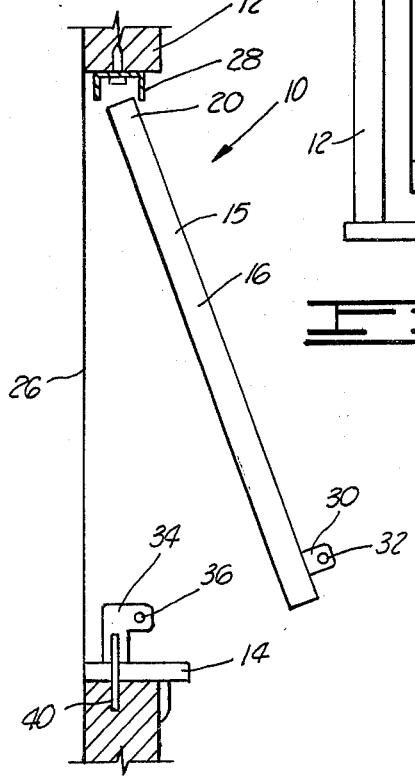
FIG. 2 is a side view of the panel frame in a position for receipt inside the "U" shaped channel.

In FIG. 2 a side view of the panel 15 can be seen with the upper member 20 in a position for receipt inside an elongated "U" shaped channel 28 which is attached along the top of the window frame 12. Also attached to the first and second side members 16 and 18 is a lock keeper 30 having an aperture 32 therethrough. The aperture 32 is indexed with an "L" shaped locking pin 34 having an aperture 36. The "L" shaped locking pin 34 is seen more clearly in FIG. 4.

Figure 3:
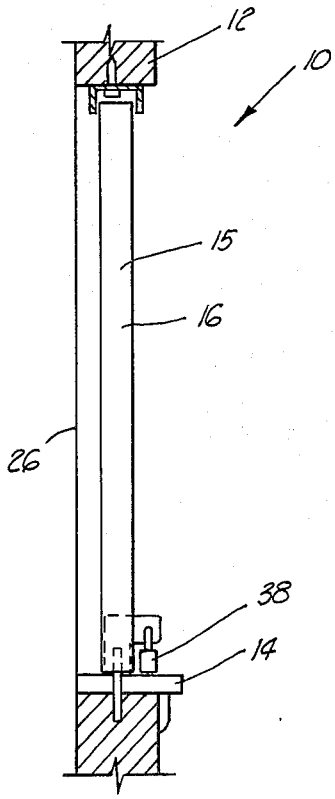
FIG. 3 is a side view of the window panel mounted in place.

In FIG. 3 the panel frame 15 is shown in its installed position received in the "U" shaped channel 28 and secured to the "L" shaped pin 34 by a lock 38 received through the aperture 36 of the locking pin 34 and the aperture 32 of the lock keeper 30.

Figure 4:
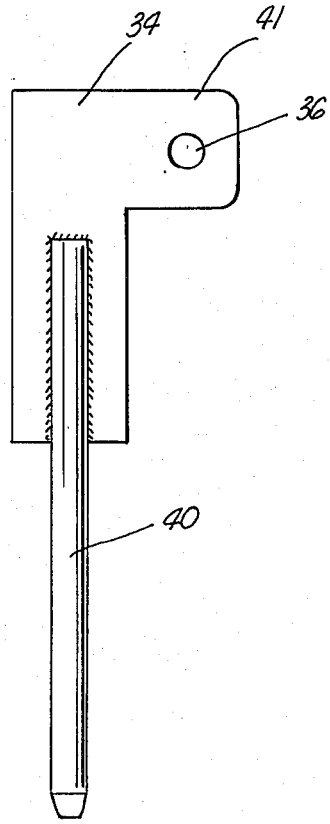
FIG. 4 is an enlarged view of an "L" shaped locking pin used for securing the window panel.

In FIG. 4 the "L" shaped locking pin 34 can be seen having a vertical arm 40 which is received through an aperture in the lower member 22 of the frame 15 and into an aperture inside the window sill 14 as shown in FIG. 2. The pin 34 also has a horizontal arm 41 having the aperture 36 therein.

Figure 5:
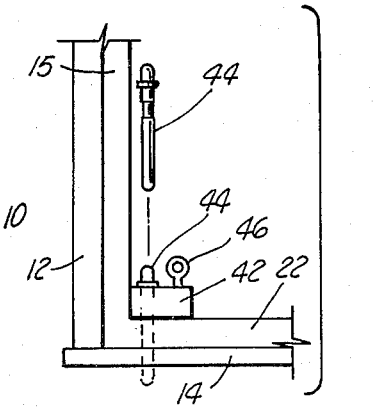
FIG. 5 illustrates the use of a drop-in pin with a locking housing and key for securing the window panel.

In FIG. 5 an alternate locking means is shown wherein a lock housing 42 is attached to the lower member 22 of the frame 15 for receiving a drop-in pin 44. The drop-in pin 44 is received inside the housing 42 and also through an aperture in the lower member 22 and into the window sill 14. A key 46 is used to lock the pin 44 inside the locked housing 42 until it is desired to remove the drop-in pin 44 and the panel 10 from the window frame 12.

Changes may be made in the construction and arrangement of the parts or elements of the embodiments as described herein without departing from the spirit or scope of the invention defined in the following claims.

What is claimed is :

1. An interior security window panel for receipt inside the frame of a window and adjacent thereto to prevent unlawful entrance through the window, the panel comprising:

a removable panel frame having a first and second side member adjacent to the sides of the window frame and an upper and lower member adjacent the top and bottom of the window frame, the frame members attached to cross members, the cross members disposed in a spaced relationship to each other, the spacing small enough to prevent human entrance therethrough;

a "U" shaped channel adapted for attachment to the inside top of the window frame, the "U" shaped channel receiving the upper member of the panel frame therein when the panel frame is disposed inside the window frame; and a "L" shaped lock pin having a vertical arm adapted for receipt through an aperture in the lower member of the panel frame and into an aperture in the window frame, the pin further having an upper horizontal arm with an aperture therethrough, the aperture indexed with an aperture in a lock keeper extending outwardly from the first side of the member, the aperture in the lock pin and the lock keeper when indexed adapted for receiving a standard lock or the like therethrough.

2. An interior security window panel for receipt inside the frame of a window and adjacent thereto to prevent the unlawful entrance through the window, the panel comprising:

a removable panel frame having a first and second side member adjacent to the sides of the window frame and an upper member and a lower member adjacent the top and bottom of the window frame, the frame members attached to cross members, the cross members disposed is a spaced relationship to each other, the spacing small enough to prevent human entrance therethrough;

a "U" shaped channel adapted for attachment to the inside top of the window frame, the "U" shaped channel receiving the upper member of the panel frame therein when the panel frame is disposed inside the window frame; and a drop-in pin adapted for receipt in a lock housing and therethrough, the end of the pin received through an aperture in the lower member of the panel frame and into an aperture in the bottom of the window frame, the lock housing attached to the lower member of the frame and locking the drop-in pin therein when the panel frame is secured inside the window.

* * * * *